US006199634B1

(12) United States Patent
Selyakov

(10) Patent No.: US 6,199,634 B1
(45) Date of Patent: Mar. 13, 2001

(54) METHOD AND APPARATUS FOR CONTROLLING THE PERMEABILITY OF MINERAL BEARING EARTH FORMATIONS

(76) Inventor: Viatchelav Ivanovich Selyakov, St. Semionovskaya nab. h 3/1, K 3/1, ft 8, Moscow (RU)

( * ) Notice: Subject to any disclaimer, the term of this patent is extended or adjusted under 35 U.S.C. 154(b) by 0 days.

(21) Appl. No.: 09/141,048

(22) Filed: Aug. 27, 1998

(51) Int. Cl.[7] ..... E21B 43/26
(52) U.S. Cl. ..... 166/248; 166/65.1; 166/250.01
(58) Field of Search ..... 166/248, 65.1, 166/250.01, 252.5, 250.02, 308

(56) References Cited

U.S. PATENT DOCUMENTS

| | | |
|---|---|---|
| Re. 30,738 | 9/1981 | Bridges et al. . |
| 2,685,930 | 8/1954 | Albaugh . |
| 2,757,738 | 8/1956 | Ritchey . |
| 2,795,279 | 6/1957 | Sarapuu . |
| 2,799,641 | 7/1957 | Bell . |
| 2,801,090 | 7/1957 | Hoyer et al. . |
| 2,818,118 | 12/1957 | Dixon . |
| 2,889,882 | 6/1959 | Schleicher . |
| 2,994,377 | 8/1961 | Trantham . |
| 3,103,975 | 9/1963 | Hanson . |
| 3,106,244 | 10/1963 | Parker . |
| 3,137,347 | 6/1964 | Parker . |
| 3,141,099 | 7/1964 | Brandon . |
| 3,141,504 | 7/1964 | Sarapuu . |
| 3,149,672 | 9/1964 | Orkiszewski et al. . |
| 3,169,577 | 2/1965 | Sarapuu . |
| 3,189,088 | 6/1965 | Cronberger . |
| 3,202,215 | 8/1965 | Stanonis . |

(List continued on next page.)

FOREIGN PATENT DOCUMENTS

1596112 A1 7/1992 (SU) .

WO 92/12326 7/1992 (WO) .

OTHER PUBLICATIONS

*Derwent World Patents* (Abstract for SU 1,596,112); Afanaseva, O.V., Latypov; M.I., Nosov, P.I.; "Forming Mineralized Liquid Filled Canal in Seams—By Delivery of Mineralized Liquid Through Hole with Negative Electrode and Passing Current Between Latter and Positive Electrode."

*Derwent World Patents* (Abstract for WO 9,212,326); Abdulmanov, I.G.; Popov, E. A.; Selyakov, V.I.; "Control of Rock Permeability in Near–Face Well Sections By Treating with Pulsed Current of Density Selected for each type of Rock."

*Primary Examiner*—Frank Tsay
(74) *Attorney, Agent, or Firm*—Mark W. Handley

(57) ABSTRACT

A method and apparatus are provided for electrically treating an earth formation to cause changes in the permeability of the formation. An electric treatment unit includes a power supply and a power section which together supply voltage pulses of an amplitude which will cause a critical current density to flow within the formation, at which irreversible changes in formation permeability occur. A power control unit controls the pulse duration and the pulse period of the voltage pulses. The voltage pulses are applied to the formation by two electrodes which are preferably connected to respective ones of the conductive casing strings of two different wells which pass through the formation. A current sensor detects the pulsed current being applied to the formation. A programmable controller operates the power control unit such that the durations and the periods of the voltage pulses are varied during different treatment time intervals to correspond to maximum values of conductivity of a zone of the formation. The maximum values of conductivity are determined for respective ones of the time intervals by detecting values of the pulse durations and the pulse periods at which saturation currents occur within the formation, and then setting the pulse durations and the pulse periods during the time intervals to provide treatment currents which are proportionate to respective ones of the saturation currents.

29 Claims, 5 Drawing Sheets

U.S. PATENT DOCUMENTS 3,208,674 9/1965 Bailey .
3,236,304 2/1966 Sarapuu .
3,288,648 11/1966 Jones .
3,417,823 12/1968 Faris .
3,428,125 2/1969 Parker .
3,507,330 4/1970 Gill .
3,530,936 9/1970 Gunderson et al. .
3,547,192 12/1970 Claridge .
3,547,193 12/1970 Gill .
3,620,300 11/1971 Crowson .
3,696,866 10/1972 Dryden .
3,718,186 2/1973 Brandon .
3,724,543 4/1973 Bell et al. .
3,766,980 10/1973 Kern .
3,848,671 11/1974 Kern .
3,916,993 11/1975 Katz .
3,920,072 11/1975 Kern .
3,946,809 3/1976 Hagedorn .
3,958,636 5/1976 Perkins .
3,972,372 8/1976 Fisher et al. .
3,989,107 11/1976 Fisher et al. .
4,008,761 2/1977 Fisher et al. .
4,008,762 2/1977 Fisher et al. .
4,016,273 4/1977 Sieger et al. .
4,037,655 7/1977 Carpenter .
4,046,194 9/1977 Cloud .
4,084,639 4/1978 Todd .
4,140,179 2/1979 Kasevich et al. .
4,140,180 2/1979 Bridges et al. .
4,144,935 3/1979 Bridges et al. .
4,193,451 3/1980 Dauphine .
4,228,853 10/1980 Harvey et al. .
4,265,307 5/1981 Elkins .
4,320,801 3/1982 Rowland et al. .
4,396,062 8/1983 Iskander .
4,401,162 8/1983 Osborne .
4,412,585 11/1983 Bouck .
4,413,679 11/1983 Perkins .
4,444,255 4/1984 Geoffrey et al. .
4,449,585 5/1984 Bridges et al. .
4,450,909 5/1984 Sacuta .
4,453,594 6/1984 Patton et al. .
4,463,805 8/1984 Bingham .
4,476,926 10/1984 Bridges et al. .
4,484,627 11/1984 Perkins .
4,485,868 12/1984 Sresty et al. .
4,498,535 2/1985 Bridges .
4,499,948 2/1985 Perkins .
4,508,168 4/1985 Heeren .
4,522,262 6/1985 Perkins .
4,524,826 6/1985 Savage .
4,524,827 6/1985 Bridges et al. .
4,532,990 8/1985 Perkins .
4,545,435 10/1985 Bridges et al. .
4,550,779 11/1985 Zakiewicz .
4,553,592 11/1985 Looney et al. .
4,567,945 2/1986 Segalman .
4,576,231 3/1986 Dowling et al. .
4,579,173 4/1986 Rosenweig et al. .
4,592,423 6/1986 Savage et al. .
4,612,988 9/1986 Segalman .
4,638,862 1/1987 Savage .
4,638,863 1/1987 Wilson .
4,640,353 2/1987 Schuh .
4,645,004 2/1987 Bridges et al. .
4,667,738 5/1987 Codina .
4,678,034 7/1987 Eastlund et al. .
4,705,108 11/1987 Little et al. .
4,730,671 3/1988 Perkins .
4,817,711 4/1989 Jeambey .
4,819,723 4/1989 Whitfill et al. .
5,101,899 4/1992 Hoskins et al. .
5,339,898 8/1994 Yu et al. .
5,620,049 4/1997 Gipson et al. .

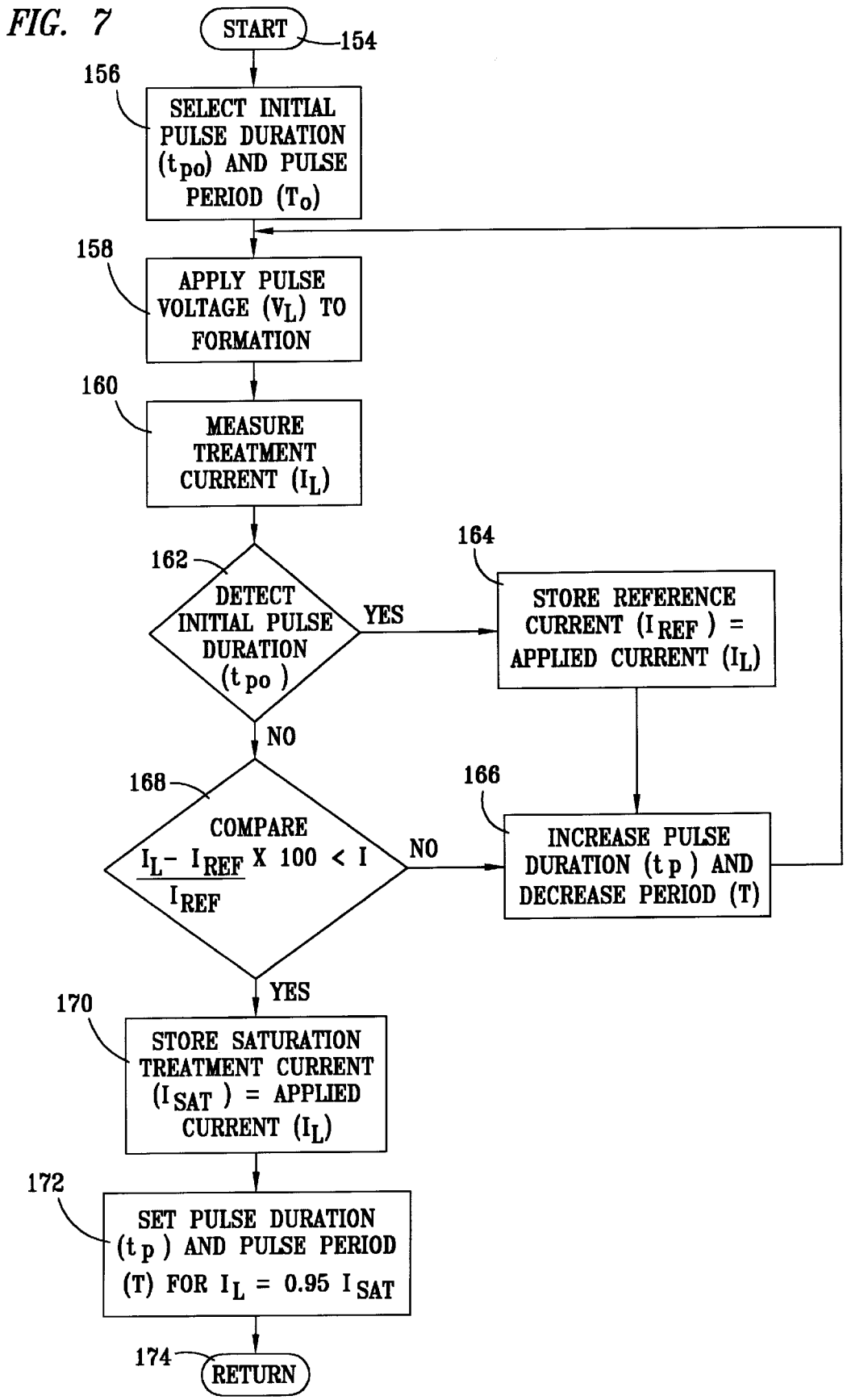
FIG. 7
START
154
156
SELECT INITIAL PULSE DURATION ($t_{po}$) AND PULSE PERIOD ($T_o$)
158
APPLY PULSE VOLTAGE ($V_L$) TO FORMATION
160
MEASURE TREATMENT CURRENT ($I_L$)
162
DETECT INITIAL PULSE DURATION ($t_{po}$)
YES
164
STORE REFERENCE CURRENT ($I_{REF}$) = APPLIED CURRENT ($I_L$)
NO
168
COMPARE $\frac{I_L - I_{REF}}{I_{REF}} X 100 < I$
NO
166
INCREASE PULSE DURATION ($t_p$) AND DECREASE PERIOD (T)
YES
170
STORE SATURATION TREATMENT CURRENT ($I_{SAT}$) = APPLIED CURRENT ($I_L$)
172
SET PULSE DURATION ($t_p$) AND PULSE PERIOD (T) FOR $I_L$ = 0.95 $I_{SAT}$
174
RETURN

METHOD AND APPARATUS FOR CONTROLLING THE PERMEABILITY OF MINERAL BEARING EARTH FORMATIONS

TECHNICAL FIELD OF THE INVENTION

The present invention relates in general to enhanced recovery of mineral and petroleum resources from earth formations, and more particularly, to a method and apparatus for electrotreatment of mineral and petroleum bearing earth formations to enhance the recovery of the mineral and petroleum resources from such earth formations.

BACKGROUND OF THE INVENTION

Recovery of minerals from earth formations has been enhanced by application of electric currents. One such method of electrotreatment was used to enhance underground leaching of metals. In this method, a preliminary electromagnetic treatment was applied to leaching muds, and then pulsed currents were passed through the muds during leaching. This resulted in increases in the solution concentrations of the metals being leached.

Another method of electric treatment for enhancing the recovery of minerals from earth formation has been used in the production of petroleum fluids from petroleum bearing earth formations. According to this method, high voltages, such as 150,000 Volts, were passed through productive zones of oil bearing formations to heat oil within the productive zones in order to increase oil production. Fixed values of the high voltages were applied to the productive zones, without controlling the amount of current passed through the productive formations. This often resulted in not only heating the oil which was in the productive zones, but also caused destruction of the pore spaces in the portions of the formations which were close to the wells. This type of treatment method often had unpredictable results on formation permeabilities and other filtration parameters when applied to different geologic formations, such that the permeabilities of the formations were often reduced rather than being improved. Application of this method in actual working wells was also difficult because of the requirement for localized application of the high voltages to downhole portions of the wells located near the productive formations, and the difficulty in electrically isolating the downhole regions of the wells to which the high voltages were to be applied.

Other methods for electric treatment of earth formations have included a method for passing pulsed electric currents through formations containing clays to cause electrochemical reactions in the clays, which resulted in destruction of the clays and increases in formation permeabilities. This method was limited in its field of use since it required formations which included clays. This method also provided unpredictable results, such as unwanted deterioration of formation permeabilities. Excessive treating currents were often applied, which resulted in increases in permeability which quickly dissipated shortly after treatments were discontinued, indicating that the increases in permeability were due to gas colmatation effects. After the gas bubbles caused by gas colmatation dissolved, the permeability quickly returned to pretreatment levels. The gas colmatation effect often dissipated after a few days. Large energy losses were often encountered.

Another prior art method is that disclosed in the PCT International Patent Application having WIPO Publication Number WO/92/12326, invented by Vyacheslav Selyakov, the inventor of the present application, and entitled "Method of Controlling Rock Permeability Of Near-Face Section Of Well." This method treats rock formations with pulsed current to increase the permeability. A critical value of a treatment current density (j*) was preliminarily established by mathematical calculations for each type of earth formation. The critical value of current density (j*) was defined as a threshold level at which irreversible changes in formation permeability began to occur, as opposed to reversible increases in permeability which decreased over relatively short periods of time. Reversible increases in permeability tended to occur when the current density (j) applied to formations was less than the critical value (j*). Irreversible decreases in formation permeability were encountered when the current density (j) applied to the formations exceeded the critical value (j*). The critical value of the current density (j*) was determined by mathematical calculations which attempted to take into account the structure of the formation, the ultimate strength of the grouting materials within formation pore spaces, and the parameters of liquids within the formation.

The calculation of the critical value of the current density (j*) for this prior art method was based on providing a desired energy density for release in thin micro-capillaries of the formation. Increases in the permeability were attained due to mechanical destruction of cementing agents disposed in the thin micro-capillaries which limited the rate of filtration of fluids through the formations. By localizing the density of energy released in these micro-capillaries, destruction of the cementing agents located therein was achieved without destroying the medium as a whole. The energy released in micro-capillaries was localized due to the nonuniformity of pore spaces within the formations. For example, when an electric current is passed through two capillaries which are connected in-series, with respective ones of the capillaries having radii $r_1$ and $r_2$, the ratio of current densities passed through each of the two capillaries is $j_1/j_2$, which is proportional to $(r_2/r_1)^2$, and the densities of electric emission are $E_1/E_2$, which is proportional to $(r_2/r_1)^4$. In actual downhole earth formations, the ratio of the radii of adjacent capillary spaces $(r_2/r_1)$ may reach 1000 and more, resulting in large values for the density of relative energy released in smaller capillaries. The localization of energy released in the small capillaries due to the varying structure of different void spaces, which interconnect to form capillaries and provide permeable paths through rock formations, were taken into account in the mathematical calculations for determining critical treatment currents in the smaller capillaries for different types of formation rocks to attain desirable changes in permeability.

After a value was calculated for the critical current density (j*), pulse durations were chosen so as not to exceed the typical time ($\tau$) for dissipation of the thermal energy in proximity to interconnected pore space capillaries located in the formation. A pulse repetition rate was selected which was less than six during a time interval which is less than the typical time ($\tau^*$) beyond which the gas colmatation of the rock takes place. An appreciable rise in the efficiency of electric treatment was achieved by using pulsed current with a duration not more than the distinctive time of dissipation of thermal energy in the nonuniformities of the medium having the size of about one grain radius. This made it possible to dramatically reduce the losses of energy introduced into the voids of the medium, and made the treatment of deep wells feasible. In some cases, gas colmatation resulted in temporary increases in permeability which lasted for only a few days. Some of the changes in the permeability occurred as a result of electrocapillary effects causing changes in the phase equilibrium of multiphase systems (water-oil, water-oil-gas). As a result of these electrocapillary effects, oil penetrated into the capillaries which previously contained water, resulting in decreases in water phase permeability. The decreases in water phase permeability changed the structure of filtration flows significantly, and often lasted for several months.

The above method for applying pulsed electric currents to restructure voids in formations and increase formation permeabilities proved unpredictable and problematic in that excessive currents were often applied. In order to destroy the cementing agents it was necessary that the current density in the capillaries exceed the threshold of the critical value of the current density value (j*), at which destruction of the cementing agents occurred. When the current density (j) passing through a capillary was below the threshold value, represented by the critical current density (j*), irreversible changes in permeability did not occur. Instead only reversible changes in permeability occurred, which were associated with the breakdown of films of bound liquids adhering to the surfaces of individual groups of capillaries. When the current density (j) applied to a capillary was higher than the threshold level, represented by the critical current density (j*), a gas phase would often develop, causing declines in permeability to the point of full termination of formation permeability. The changes in permeability which resulted from excessive currents being applied were often of a reversible nature, and lasted for only a few days. The excessive currents also caused gas colmatation which resulted in excessive pressures that irreversibly destroyed formation permeabilities. In some formations, excessive pressures which were above levels for dissipation of clays and cementations materials often caused damage to the formation rock matrix, which effectively destroyed formation permeability.

SUMMARY OF THE INVENTION

The present invention is directed toward a method and apparatus for electrically treating an earth formation to cause changes in the permeability of the formation. The apparatus is an electric treatment unit which includes a three phase power supply and a power section. The power supply is set to output a supply voltage to the power section of a voltage amplitude which will cause a critical current density to flow within the formation. The critical current density is the threshold value of the current density at which irreversible changes in formation permeability occur. The power section is controlled by a power control unit to output voltage pulses of selectable pulse durations and pulse periods. The voltage pulses are applied to the formation by two electrodes which are preferably connected to respective ones of the conductive casing strings of two different wells which pass through the formation. A current sensor detects the pulsed current being applied to the formation. The power control unit is operated by a programmable controller such that the durations and the periods of the voltage pulses are varied during different time intervals of treatment to correspond to maximum values of conductivity of a zone of the formation within which pulsed treatment currents are being induced by the voltage pulses. The maximum values of conductivity are determined for respective ones of the time intervals by detecting critical values of the pulse durations at which saturation currents occur within the formation. Then, the pulse durations and the pulse periods during the time intervals are set to provide treatment currents which are proportionate to the respective saturation currents. The value of the treatment pulse durations are preferably set to be within a range of one-half to five times the values of corresponding critical pulse durations, and the period of the pulses are preferably set to have values which are not substantially greater than ten times the value for the corresponding pulse durations.

BRIEF DESCRIPTION OF THE DRAWINGS

For a more complete understanding of the present invention and the advantages thereof, reference is now made to the following description taken in conjunction with the accompanying Drawings in which:

FIG. 7 is a block diagram illustrating a method of determining and setting pulse durations and pulse periods for applying pulsed treating currents to the formation.

DETAILED DESCRIPTION OF THE INVENTION

Figure 1:
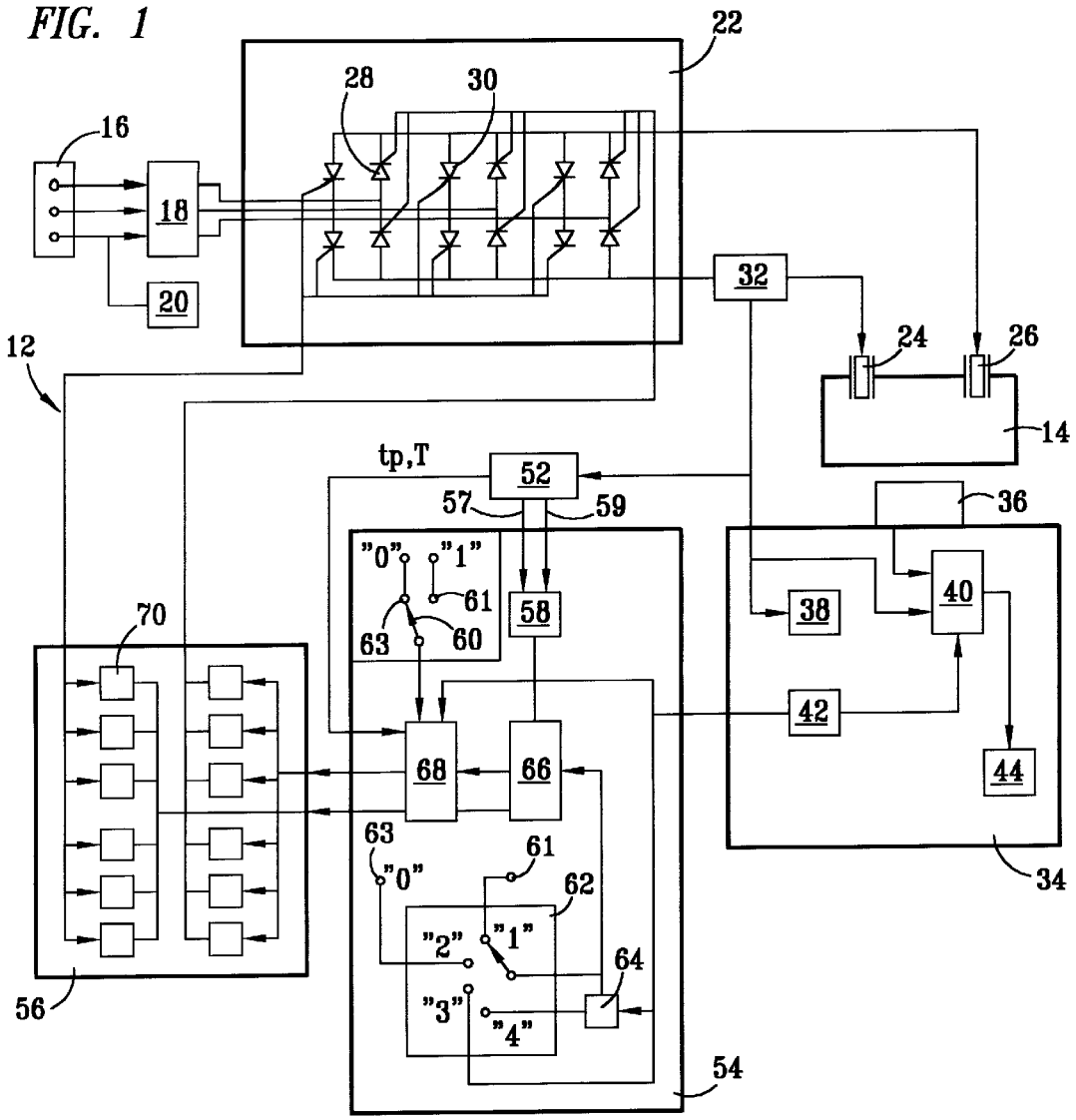
FIG. 1 is a schematic diagram of a treatment unit for treating a formation zone according to the present invention.

FIG. 1 is a schematic diagram of a treatment unit 12 for treating a zone 14 of an earth formation according to the present invention. The treatment unit 12 is connected to an external power source 16, which is preferably rated to supply 500 kW of electric power. The external power source 16 preferably provides three-phase electric power to a power supply 18 and single-phase electric power to a power supply 20 of the treatment unit 12. The power supply 18 is preferably a three-phase transformer which provides electric power that is selectively applied to the earth formation 14 by operation of the treatment unit 12. The output voltage of the power supply 18 is selectable, preferably by changing connections to transformer taps. The power supply 20 is a low-voltage power supply for powering the control and logic units of the present invention. The treatment unit 12 further includes a power section 22 which is selectively actuated to apply voltage across electrodes 24 and 26, to cause electric current to flow through the formation zone 14. The electrodes 24 and 26 are preferably separately connected to metal casing strings of two separate wells, with a respective one of the electrodes 24 and 26 connected to each well, above the ground surface of the wells. In some embodiments, the electrodes 24 and 26 may be lowered downhole, into the wells, to depths approaching or at the actual depth at which the formation 14 being treated is located. In other embodiments, the electrodes 24 and 26 may be disposed in a spaced apart relation within a singular well for treating a formation 14.

The power section 22 includes a plurality of power thyristors 28 and 30, preferably provided by silicon controlled rectifiers, which are arranged in two banks of thyristors 28 and 30, respectively, one for applying voltage to the electrode 24 and the other for applying voltage to the electrode 26. The power thyristors 28 and 30 are connected to the three-phase transformer taps of the power supply 18, such that when respective ones of the two banks of power thyristors 28 and 30 are activated, voltage of selected polarity will be applied to corresponding ones of the electrodes 24 and 26. A current sensor 32 is provided for sensing the current being applied by the power section 22 to the electrodes 24 and 26. The output of the current sensor 32 is connected to a monitoring unit 34 for monitoring the electric current being applied through the electrodes 24 and 26 to the formation zone 14. A reference voltage input 36 is also connected to the monitoring unit 34. The monitoring unit 34 includes a measuring unit 38, which provides an output corresponding to the value of the treatment current sensed by the current sensor 32. A comparator 40 compares the output of the current sensor 32 to the reference voltage input 36. A timing input 42 is provided for actuating the comparator 40 to compare the output from the current sensor 32 to the output from the reference voltage 36. The timing input 42 may be provided by a one-shot multi-vibrator circuit. When the output from the current sensor 32 drops beneath the reference voltage from the input 36, the comparator 40 will provide a signal which activates an alarm 44 to indicate that the current being applied to the formation 14 has dropped beneath a selected reference value. The alarm 44 may be a visual or audible alarm.

The treatment unit 12 further includes a data processing unit 52. The data processing unit 52 is connected to the output of the current sensor 32. Various values of the current being applied to the formation 14 are input into the data processing unit 52. The data processing unit 52 is preferably provided by a computer of the type commonly used as personal computers, having a writeable storage media for storing data relating to preselected control parameters and sensed operating parameters of the treatment unit 12. The data processing unit 52 is connected to a logic control unit 54, which provides selectable control of operation of a power control unit 56. The power control unit 56 has outputs which are electrically actuated by the data processing unit 52 and the logic control unit 54 to control operation of the power thyristors 28 and 30 of the power section 22. It should be noted that in other embodiments of the present invention, various features of the logic control unit 54 may be incorporated as control program steps which control the operation of the data processing unit 52.

The logic control unit 54 sets the timing of the electric pulses applied to the formation, and comprises a controlled square pulse generator 58, a master state switch 60, an operation mode selection switch 62, a frequency divider 64, a flip-flop circuit 66 and a logic coincidence unit 68. The square wave signal generator 58 is preferably an oscillator which is controlled by two outputs 57 and 59 from the data processing unit 52. The output 57 controls the duration ($t_p$) of output pulses from the oscillator 58. The output 59 controls the period (T) of the output pulses from the oscillator 58. The oscillator 58 provides a series of square pulses to the mode selection switch 62, to the frequency divider 64 and to the logic unit 68. The frequency divider 64 is connected to the mode switch 62 and to the flip-flop logic control unit 66. The flip-flop logic control circuit 66 is connected to the logic unit 68. The logic unit 68 may be provided by a four-input "AND" gate with paraphase outputs. The logic unit 68 is connected to the master state switch 60 and has outputs which provide outputs from the logic control unit 54 for controlling operation of the power control unit 56.

The master state switch 60 is operable for moving between two positions to select between an enabled and a disabled state of operation for the logic control unit 54 and the treatment unit 12, which enables or disables the output of pulsed voltage to the electrodes 24 and 26. In a first position, the switch 60 contacts an enable terminal 61, which is set at a logic voltage level representing a logic state of "1." In the second position, the switch 60 contacts a disable terminal 63, which is set at a logic voltage level representing a logic state of "0." The switch 60 applies the contacted logic level to the logic coincidence unit 68. When the switch 60 applies the logic state of "1" to the logic coincidence unit 68, control pulses may be applied from the power control unit 56 to the power thyristors 28 and 30. When the switch 60 applies a logic state of "0" to the logic coincidence unit 68, control pulses cannot be output from the power control unit 56 and applied to the power thyristors 28 and 30, so that voltage will not be applied across the electrodes 24 and 26, and to the the formation 14.

The operating mode switch 62 provides a manual input for selecting between several modes of operation of the treatment unit 12, which selects the polarity of the pulses output from the power section 22, and the sequence of the reversing of the polarity of such pulses. In other embodiments, such operating modes may be selected and controlled by operation of the data processing unit 52. The mode selection switch 62 is selectively movable between four positions to selectively engage contacts 1–4, which selectively connects an input of the logic control unit 66 to the terminals 61 and 63, the output of the oscillator 58 and the output of the frequency divider 64, respectively. The frequency divider 64 is preferably selected to changes states after a selected number of output pulses are emitted from the oscillator 58. The various modes of operation provided by the switch 64 allow for reversing of the polarity of the treatment pulses to prevent electrochemical reactions from causing deterioration of the well casing and the electrodes 24 and 26.

Figure 2:
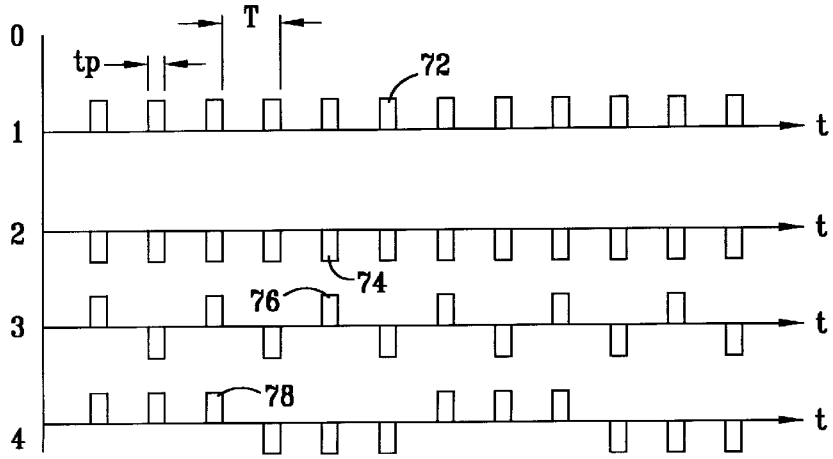
FIG. 2 is a timing diagram which schematically illustrates the voltage pulses output by the treatment unit in selectable operating modes.

FIG. 2 is a timing diagram which schematically depicts the electric pulses which are output by the treatment unit 12 in the four different operating modes selected with the mode selection switch 62. For each of the four positions 1 through 4 of the mode selection switch 62, respective voltage pulses 72, 74, 76 and 78 are output with pulse durations ($t_p$) and pulse periods (T). In the first operating mode, the mode switch 62 is placed in the first position and engages the contact 1, causing a continuous sequence of treatment pulses 72 of positive polarity to be applied to the electrodes 24 and 26, and the formation 14. In the second operating mode, the mode switch 62 is placed in the second position and engages the contact 2, causing a continuous sequence of negative polarity pulses 74 to be applied to the electrodes 24 and 26, and the formation 14. In the third operating mode, the switch 62 is placed in the third position and engages the contact 3, and treatment pulses 76 of alternating polarity are output, with temporally adjacent ones of pulses 76 being of opposite polarity. In the fourth operating mode, the switch 62 is placed in the fourth position and engages the contact 4 to cause the output of treatment pulses 78 of packets of different polarity. The electric treatment pulses 78 have polarities that alternate in a sequentially grouped fashion, with a first set, or packet, of a plurality of temporally adjacent ones of the pulses 78 having a positive polarity, followed by a second set, or packet, of a plurality of temporarily adjacent ones of the pulses 78 having an opposite polarity from that of the first set of pulses 78.

Referring again to FIG. 1, the power control unit 56 includes a plurality of electro-optic isolator 70, which are arranged into two banks. The electro-optic isolators 70 are preferably of the galvanic type, and serve to isolate the output of the logic unit 68 of the logic control unit 54 from the power thyristors 28 and 30 of the power section 22 so that voltage spikes will not cause damage to the logic components of the logic control unit 54.

In operation, the electrodes 24 and 26 are electrically connected to spaced apart points within the formation 14, preferably by connecting each of the electrodes 24 and 26 to separate casing strings of two different wells. The two different wells are spaced apart, and need not be adjacent. In the alternative, the electrodes 24 and 26 may be disposed within a single well, such that the electrodes 24 and 26 are electrically connected to two spaced apart points of the formation, respectively. The productive zone being treated is preferably flowing during treatment, such that produced fluids will displace particulates which result from breaking up of cementing and other types of materials removed from within the capillaries by electrotreatment.

The treatment current ($I_L$) to be applied to a formation zone is first selected according to a desired current density (j) for passing through the formation zone. A preliminary value for the pulsed current density (j) is selected which corresponds to a particular type of rock of which the formation is comprised. This value is preferably not less than a critical value (j*) of the pulsed current density which determines the character of change of rock permeability, taking into account the structure of voids in the formation and parameters of a saturating liquid in the formation. During operation, a critical value of pulse length tp* is experimentally determined, and then the applied pulse duration (tp) is selected according to the equation:

$$tp=B\ tp^*,$$

where B=0.5–5.0.

A period for the emitted pulses is preferably chosen such that the period (T), which is the on-off time ratio of the pulses, is less than 10. The emitted treatment pulses are applied to the formation zone for a period of time (t) which does not exceed a critical time of treatment (t*), upon the exceeding of which the yield of the well would be reduced.

The critical current value (j*) is determined by the equation:

$$j^* = k\sqrt{\frac{(E_a)(m)}{(\rho_e)(\tau)}}$$

where k is a coefficient characterizing the structure of a void in the medium, k=0.5–0.001;

$E_a$ is activation energy of process (j), m is the porosity of the medium, (fractions of a unit);

$\rho_e$ is the specific resistance of the saturating liquid, (Ohm);

τis the peculiar scale of time of energy dissipation (s).

In the case of electrotreatment with the aim of changing permeability of the bottomhole part of a well, $E_a$ may be approximated using the equation:

$$E_a = \frac{\alpha\delta * C\rho}{\beta}$$

where δ* is the minimum value of the tensile strength of a cementing agent for cycles influence, (bar);

C is the heat capacity of a solution, (J/kg degree);

ρ is the density of the medium, (kg/m);

β is the coefficient of thermal expansion of the saturating liquid, (1/degree); and α is the coefficient of volume expansion of the saturating liquid, (1/bar).

In the case of controlling phase permeability, a value for $E_a$ is preferably determined experimentally.

A value for τ may be estimated by the equation:

$$\tau = \frac{d^2}{a^2},$$

where d is the peculiar scale of nonuniformity, e.g., grain size, (m);

$a^2$ is the piezoconductivity coefficient, $\alpha^2=\lambda/C\ \rho(m^2/s)$;

(λ is the heat conductivity coefficient, [J/m degree s]).

A value for a desired critical treatment current (I*) which corresponds to the critical current density (j*) may be determined according to geometrical parameters of the bottomhole portion of well through which a formation zone is being treated, using the equation:

$$I^*=2\pi RwHj^*,$$

where Rw—the well radius,

H—the depth of a well.

The treatment voltage ($V_L$) for a desired treatment current ($I_L$) may be selected by switching output terminals of secondary windings of the transformer 18, and then measuring the amplitude ($I_L$) of the current pulses passing into the formation 14 with the current sensor 32. A value is set for the treatment current ($I_L$) flowing into the formation 14 such that $I_L>I^*$, so that the treating current density (j) is greater than the critical current density j*, or j>J* .

Figure 3:
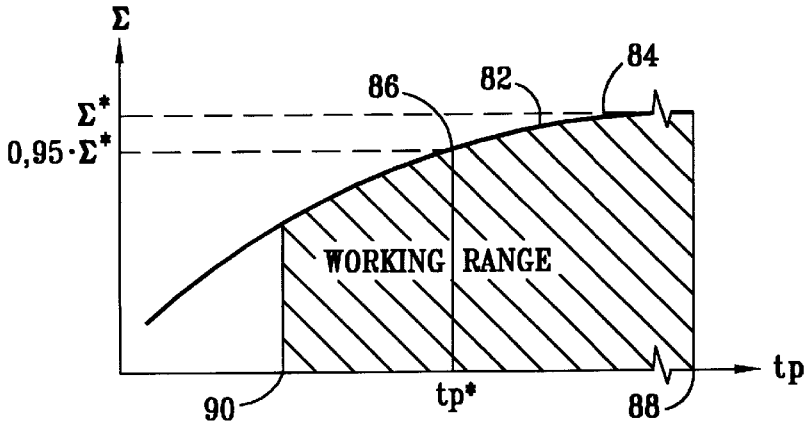
FIG. 3 is a plot of conductivity of the formation verses different pulse durations of pulsed electric current applied to the formation.

FIG. 3 is a plot of a curve 82 which represents the conductivity (Σ) of the formation 14 versus the duration ($t_p$) of the electric pulses applied to the formation 14 by the treatment unit 12. The curve 82 shows an exponential relationship between the pulse duration ($t_p$) and the formation conductivity (Σ). At a point 84, the conductivity of the formation 14 will effectively reach its maximum value. The conductivity of the formation is defined by the equation Σ×R=1. Since a fixed voltage is applied by the electrodes 24 and 26 to the formation 14, the conductivity (Σ) will be proportional to the current ($I_L$) passing through the formation 14, and the point 84 which represents the maximum conductivity (Σ*) of the formation will occur at pulse duration ($t_p$) of a value at which a saturation current ($I_{SAT}$) is being passed through the formation which corresponds to the point 84. The saturation current ($I_{SAT}$) is preferably determined by incrementally increasing the pulse duration ($t_p$) until a change in the treatment current ($I_L$) is less that one percent. This change in the treatment current ($I_L$) of less that one percent may be an incremental change caused by an incremental increase in the pulse duration ($t_p$) of the emitted pulses, or a change from a selected reference value for the current ($I_L$). The treatment current ($I_L$) at which of the change of less than one percent is detected is taken as the saturation current ($I_{SAT}$) for the next treatment interval. Then, a critical operating pulse duration ($t_p$*) is determined, which corresponds to the pulse duration ($t_p$) at which the treatment current ($I_L$) is equal to ninety-five percent (95%) of the saturation treatment current ($I_{SAT}$). The duration ($t_p$) of the treatment pulses applied to the formation will preferably be set to a value which is in the range of 0.5 times to 5.0 times the preferred pulse durations ($t_p$*), represented by the points 90 and 88, respectively. The period (T) of the treatment pulses is preferably set to a value which is in a range of 5.0 to 10.0 times the selected pulse duration ($t_p$)

Figure 4:
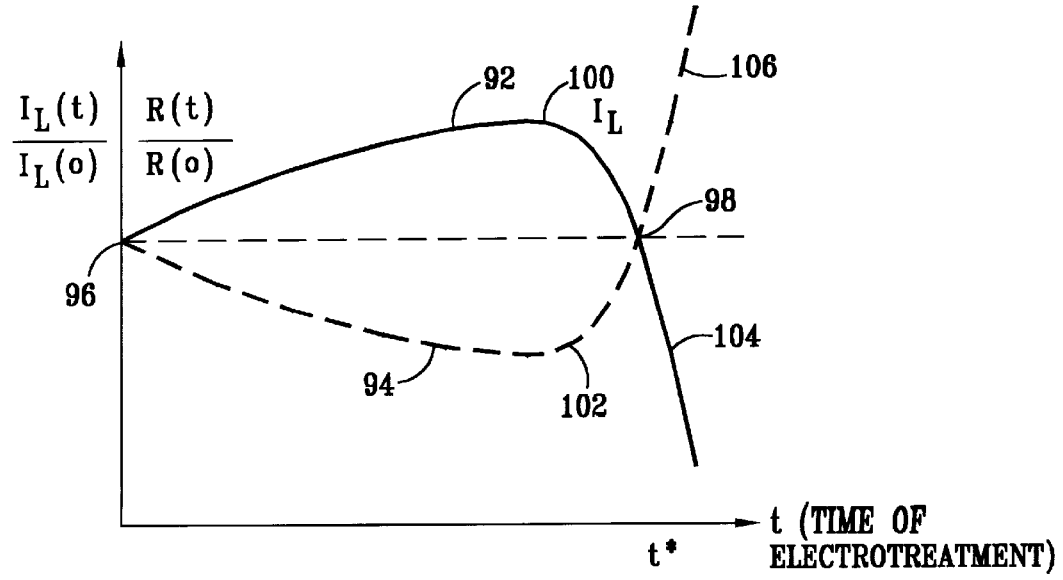
FIG. 4 is a plot of the specific resistivity of the formation, the specific current applied to the formation and the conductivity of the formation verses the time of electrotreatment of the formation.

FIG. 4 is a plot of specific conductivity (Σ) of the formation 14 over time of electrotreatment, represented by a curve 92, and a plot of specific resistivity (ρ) of the formation 14 represented by a curve 94. The values for the specific conductivity (Σ) represented by the curve 92 are preferably determined by dividing the treating current ($I_L$) at a time (t) during the treatment by the initial treatment current ($I_{L0}$), at time ($t_0$), when the electrotreatment began. The values for the specific resistivity (ρ) of the formation 14 are represented by the curve 94, which is preferably determined by dividing the resistivity R(t) at a time during electrotreatment by the initial resistence ($R_0$) of the formation 14 at time ($t_0$) at which the electrotreatment began. The initial time ($t_0$) at which treatment is initiated is depicted at a point 96, and the critical time of treatment (t*) by which treatment is preferably ended is depicted at a point 98. The specific conductivity (Σ) of the formation will increase to a point 100, at which time it will sharply decrease and pass through the point 98 at which the treatment current passing through the formation will be approximately equal to the initial treatment current occurring at time $t_0$ at point 96. Likewise, the specific resistivity (ρ) depicted by the curve 94 will gradually decrease until it reaches a minimum point 102, at which point it will exponentially increase until it passes through the point 98, at which point the resistivity of the formation 14 will be approximately equal to that at time $t_0$, represented by the point 96. Then, the specific conductivity (Σ) will sharply decrease in the region 104 and the specific resistivity (ρ) will sharply increase in a region 106. According to the present invention, electrotreatment is preferably discontinued when the specific conductivity (Σ) and the specific resistivity (ρ) are approximately equal to the initial values of the specific conductivity (Σ) and the specific resistivity (ρ), respectively, in order to avoid colmatation. The specific conductivity (Σ) sharply decreases and the specific resistivity (ρ) sharply increases when colmatation occurs. Additionally, the specific conductivity (Σ) reaches a maximum value and the specific resistivity reaches a minimum value (ρ) at a point just prior to colmatation occurring. Treatment will preferably not continue past the critical treatment time (t*) at which colmatation begins to sharply affect the specific conductivity (Σ) and the specific resistivity (ρ) of the zone of the formation being treated.

After the treatment voltage ($V_L$) is selected to provide a desired treatment current ($I_L$) which corresponds to the desired critical current density (j*), the programmable controller is operated to output signals to the control inputs 57 and 59 of the oscillator 58. The two control inputs 57 and 59 are set to provide pulse durations ($t_p$) and pulse periods (T) for the treatment unit 12. The pulse period (T) is selected such that the pulse period-to-pulse duration ratio is in the range of 5.0 to 10.0, according to a mean value for the pulse duration ($t_p$*). The treatment pulse duration ($t_p$) is selected such that the treatment current ($I_L$) is proportional to the saturation current ($I_{SAT}$) by a selected ratio, preferably being equal to ninety-five percent of the saturation current ($I_{SAT}$). The saturation current ($I_{SAT}$) is the maximum mean of current induced to flow into the formation, and corresponds to the mean of the maximum means of the formation conductivity (Σ). Then a treatment pulse duration ($t_p$) is selected, using the equation $t_p$=B $t_p$, where B=0.5–5.0. If the value for the coefficient B is less than 0.5, the pulse duration $t_p$ is of to short a duration and the electrotreatment is not effective. Likewise, if the value for the coefficient B is greater than 5.0, the number of cycles of the treatment current pulses being applied to the formation is not of a sufficient enough frequency and the electrotreatment is not effective.

After electrotreatment is initiated, a voltage output from the current sensor 32 which corresponds to a value of the initial treatment current ($I_0$) is selected for storing in the reference input 36 as a reference value. If the critical pulse duration ($t_p$*) is selected for the treatment pulse duration ($t_p$), then the reference value will be substantially equal to the value of the saturation current ($I_{SAT}$) during the first treatment time interval, being ninety-five percent of the value for the saturation current ($I_{SAT}$) During the electrotreatment process, the comparator 40 compares the output of the current sensor 32 to the reference value which is output by the reference input 36. The comparator 40 compares the initial treatment current ($I_0$) to the treatment current ($I_L$) being applied to the formation when the comparator 40 is actuated by the timing input 42. The duration of the time interval over which the timing input 42 actuates the comparator 40 is preferably selected such that it is less than the duration of the treatment pulses ($t_p$).

Periodically, not less than one time per hour, the process of determining the saturation current ($I_{SAT}$) and the critical pulse duration ($t_p$*) is repeated to define separate treatment time intervals. The treatment pulse duration ($t_p$) is incrementally increased until a saturation current ($I_{SAT}$) is detected. The critical pulse duration ($t_p$*) is the pulse duration ($t_p$) at which the treatment current ($I_L$) is proportionate to saturation current ($I_{SAT}$). Preferably, the value for treatment current ($I_L$) which corresponds to the critical pulse duration ($t_p$*) is selected to be slightly less than the saturation current ($I_{SAT}$), such as ninety-five percent of the saturation current ($I_{SAT}$) The pulse duration ($t_p$) for treatment is preferably equal to ($t_p$*), but may also be selected be proportionate to the critical pulse duration ($t_p$*), within the range of one-half to five times the critical value ($t_p$*) of the pulse duration. The period (T) of the treatment pulses is then selected to be proportionate to the duration of the treatment pulses ($t_p$), preferably being within a range of 5.0 to 10.0 times the treatment pulse duration ($t_p$).

If the value of the critical treatment pulse duration ($t_p$*) is used for the treatment pulse duration ($t_p$) during a treatment interval, then the treatment current ($I_L$) will be slightly less than the saturation current ($I_{SAT}$). As discussed above in reference to FIGS. 3 and 4, the saturation currents ($I_{SAT}$) correspond to maximum values for the formation conductivity (Σ). Selecting treatment pulse durations ($t_p$) which are substantially equal to critical treatment pulse durations ($t_p$*) results in initial treatment currents ($I_L$) being applied at the beginning of treatment time intervals which are slightly less than the detected saturation currents ($I_{SAT}$). Thus, increases in the formation conductivity (Σ) during a treatment interval for a particular detected ($I_{SAT}$), such as for a one hour period, will not result in treatment currents ($I_L$) which are substantially greater than the detected saturation currents ($I_{SAT}$). This provides for optimization of the electrotreatment process when the treatment pulse durations ($t_p$) are substantially equal to the detected critical pulse duration ($t_p$*) since the process will operate at values of the formation conductivity (Σ) which are substantially equal to the maximum for the formation being treated.

When the comparator 40 detects a value of ($I_L$) which is preferably equal to or less than initial treatment current ($I_0$), the comparator 40 sends a signal to the alarm 44 to indicate that the process of electrotreatment has been completed, and that electrotreatment should be stopped. This occurs as a result of increasing of resistivity between electrodes 24 and 26, and marks the beginning of decreases in the yield from the formation as a result of gas colmatation. In other embodiments, treatment may be discontinued upon the detection of initial decreases in the treatment current ($I_L$) that corresponds to decreases in detected saturation currents ($I_{SAT}$), which indicates that electrotreatment is occurring between points 100 and 98 of FIG. 5. Preferably, the treatment is discontinued when the treatment current ($I_0$) is substantially equal to the initial treatment current ($I_{L0}$).

Figure 5:
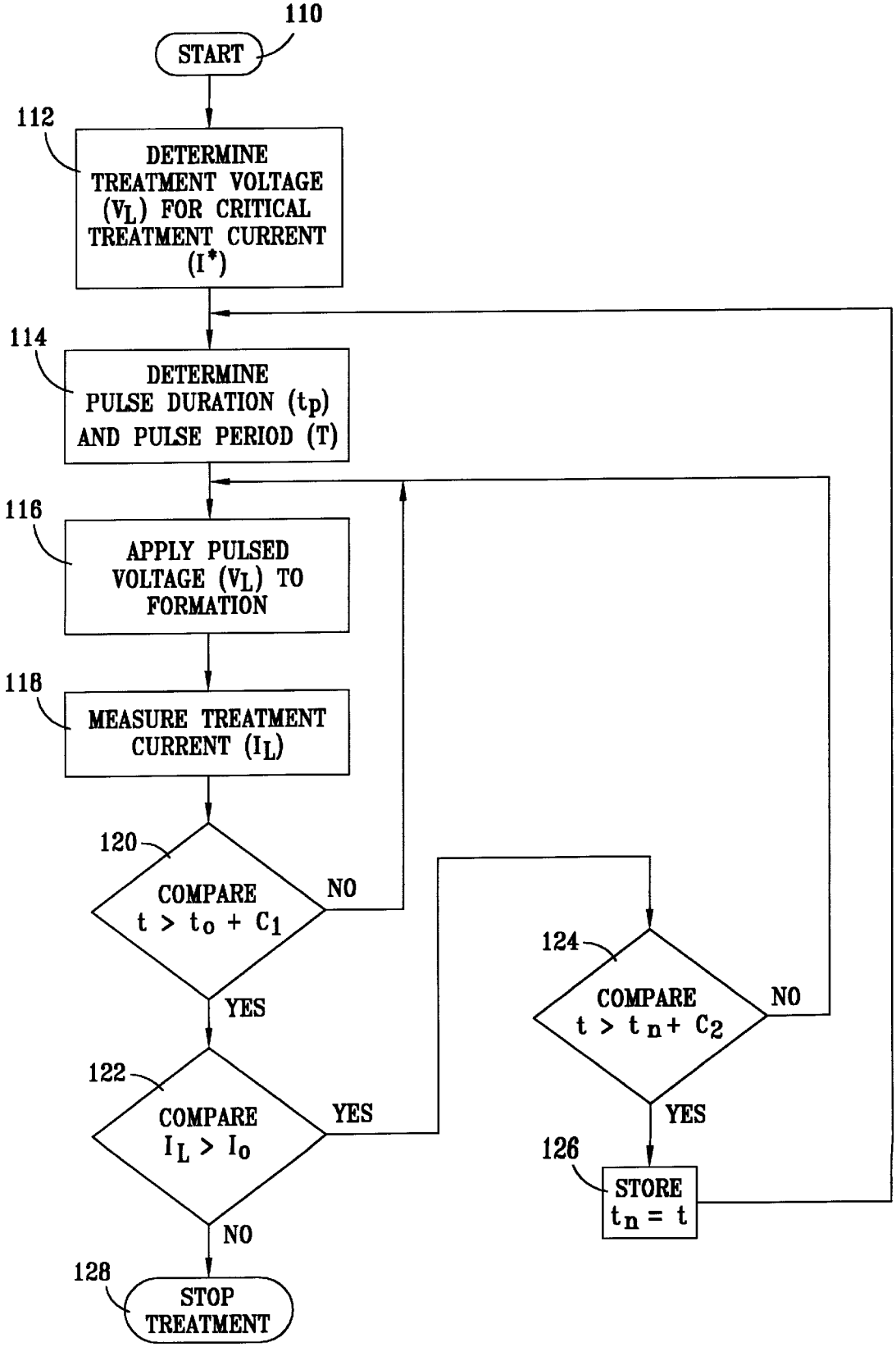
FIG. 5 is a block diagram illustrating a method of operating the treatment unit for treating a formation with a pulsed electric current.

FIG. 5 is a block diagram illustrating operation of unit 12 according to a method of the present invention starting at terminal 110. In a block 112, amplitude values for the treatment voltage ($V_L$) and the critical treatment current ($I_L$) are determined. Then, the pulse duration ($t_p$) and pulse (T) are determined in a block 114. The pulse voltage ($V_L$) is then applied to the earth formation being treated in a block 116. During treatment, the current being passed through the formation ($I_L$) in response to the pulse voltage ($V_L$) being applied to the formation 14 is measured by sensor 32, in a block 118. A decision block 120 represents the comparison of the present time to an initial time ($t_o$) plus a constant ($C_1$). The decision block 120 is provided to determine when to make a comparison of the presently applied treatment current ($I_L$) to the initial treatment current ($I_o$) in order to make the determination of whether the treatment current is falling below the point 98 depicted for the curve 92 in FIG. 4. The decision block 120 assures that the treatment process has moved from the initial time ($t_0$) which is proximate to the initial starting point 96 of curve 92 in FIG. 4. If the value for the time (t) is greater than the initial time ($t_0$) plus a constant ($C_1$), the process will pass to a decision block 122. If not, the process will flow back to the block 116, and then the treatment unit 12 will continue to apply the pulsed voltage ($V_L$) to the earth formation. Once the time (t) is greater than the initial time ($t_0$) plus a constant ($C_1$), the process moves to the decision block 122 in which a comparison is made to determine whether the treatment current ($I_L$) being applied to the formation is greater than the initial treatment current ($I_0$). If the present treatment current ($I_L$) is less than the initial treatment current ($I_0$), then the treatment process has gone past the final treatment point 98 of the curve 92 in FIG. 4. The system will then proceed to the stop terminal 128, and the alarm 34 of the treatment unit 12 of FIG. 1 is activated. If the measured treatment current ($I_L$) is greater than the initial current ($I_0$), the process is located between the points 96 and 98 of the curve 92 of FIG. 4, and the process will then flow from the decision block 122 to a decision block 124. The decision block 124 then determines whether the current time (t) is greater than the sum of a previous time ($t_n$) plus a constant ($C_2$). If not, then the treatment unit 12 will proceed back to the block 116 and continue to apply the pulsed voltage ($V_L$) to the earth formation. If the current treatment time is greater than the previous time ($t_n$) plus a constant ($C_2$), then treatment unit 12 will proceed from the block 124 to a block 126, and the present (t) is stored as the previous time ($t_n$) for the next comparison represented by the block 124. The initial value for ($t_n$) will be the initial time ($t_0$). Then the method will proceed from the block 126 to the input of the block 114, where the pulse duration ($t_p$) and the pulse (T) are determined.

Figure 6:
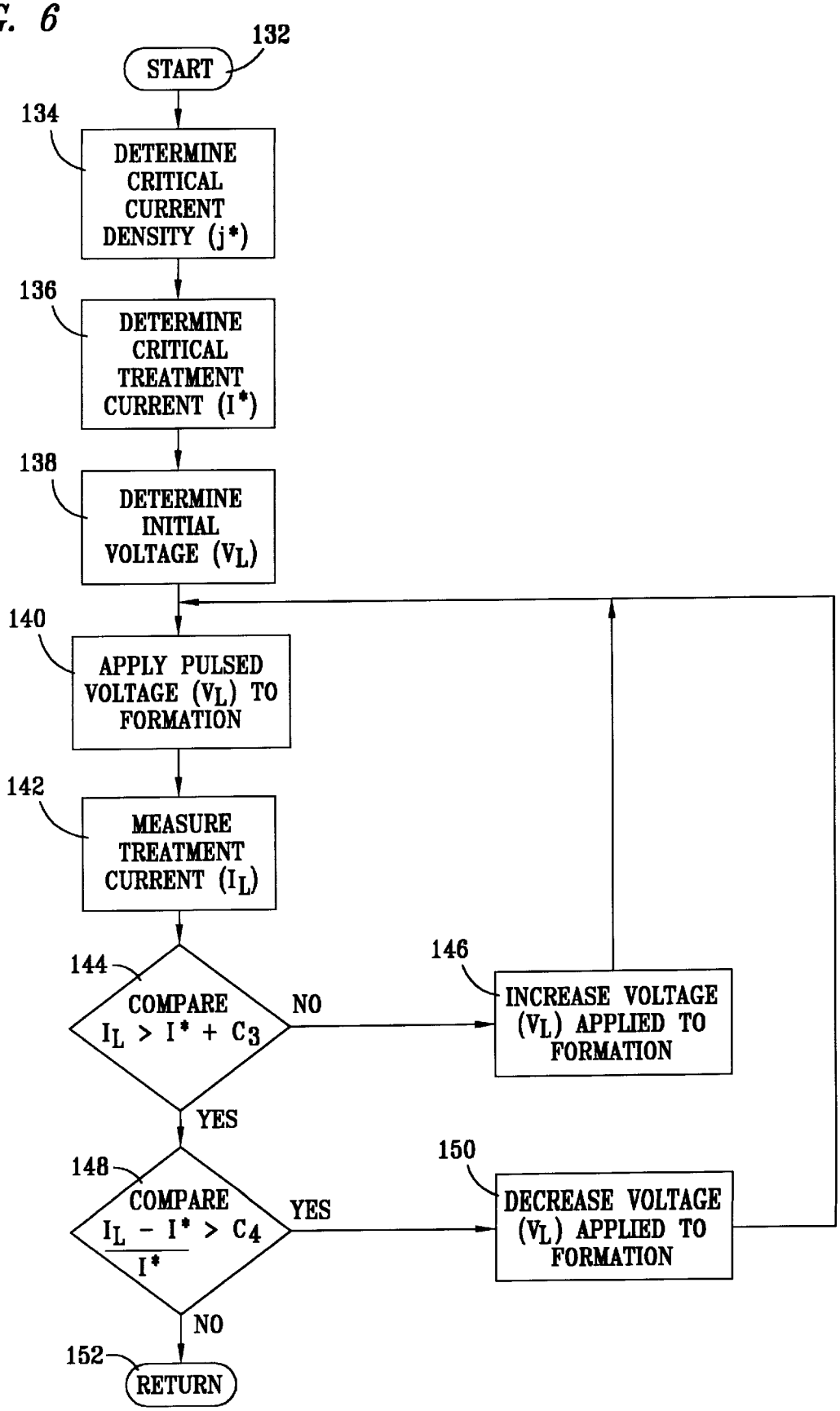
FIG. 6 is a block diagram illustrating a method for determining an initial treatment voltage which induces a critical treatment current to flow within the formation.

FIG. 6 is block diagram illustrating operation of the treatment unit 12 and a method according to the present for determining the initial treatment voltage ($V_L$) and the initial treatment current ($I_L$), such as that depicted in the block 112 of FIG. 5. The method begins with a start step depicted by a terminal 132. A block 134 depicts a step of determining the critical current density (J*). This value is calculated according to the equations set forth above. Then, in a block 136 the critical treatment current (I*) is determined as set forth in the above equations. A block 138 depicts the step of selecting the initial treatment voltage ($V_L$). The selected, initial voltage ($V_L$) is applied to the formation, as depicted in a block 140. A block 142 then depicts the step of measuring the treatment current ($I_L$) which results from application from initial treatment voltage ($V_L$) to the formation. The method then proceeds to a decision block 144, which depicts the treatment current ($I_L$) being compared to the sum of the critical treatment current (I*) plus a constant ($C_3$). If the treatment current ($I_L$) is less than the sum of the critical treatment current (I*) plus the constant ($C_3$), then the method proceeds to the step depicted by a block 146, in which the treatment volts ($V_L$) is increased to increase the treatment current ($I_L$) applied to the formation is increased by an incremental unit. The process then proceeds back to the block 140 where the voltage is applied to the formation. If in the block 144 the treatment current ($I_L$) is greater than the sum of the critical treatment current (I*) plus a constant ($C_3$), the method then proceeds to a block 148 at which the result of the difference between the treatment current ($I_L$) subtracted by the critical treatment current (I*), divided by the initial current (I*), is compared to a constant ($C_4$). If the result is greater than ($C_4$), the method proceeds to a block 150, which depicts decreasing the voltage ($V_L$) applied to the formation and returning back to the input of the block 140, which represents the step of applying the treatment voltage ($V_L$) to the formation. If the result is less than the constant $C_4$, the system proceeds to the stop step depicted by the terminal 152.

FIG. 7 is block diagram illustrating a preferred method for operating the treatment unit 12 according to the present invention, to determine the pulse duration ($t_p$) and the pulse period (T), such as that set forth in the block 114 of FIG. 5. A start step is depicted by a terminal 154. The method then proceeds to the step of selecting an initial pulse duration value ($t_{P0}$) and an initial pulse period ($T_0$) in a block 156. The process then proceeds to a block 158, in which the voltage pulses ($V_L$) are applied to the formation. In a block 160, the step of measuring the treatment current ($I_L$) applied to the formation is depicted. A decision block 162 depicts a comparison of whether the initial pulse duration ($t_{P0}$) is being applied to the formation. If so, the process proceeds to a block 164, in which the applied treatment current treatment ($I_L$) is stored as the reference current ($I_{REF}$). Preferably, an initial pulse duration ($t_p$) of a nominal value or one-half of the previously preceding pulse duration $t_p$ value is selected if treatment has already been occurring. Then, the process will flow to a block 166 which depicts the step of increasing the pulse duration ($t_p$) and decreasing the pulse period (T) by preselected incremental values. The method will then proceed from the step depicted in the block 166 back to the input of the step depicted by the block 158, in which the voltage pulses ($V_L$) are applied to the formation.

If in the decision block 162 the initial pulse duration ($t_{P0}$) is not being currently applied, the process will proceed to the step depicted in a block 168 of determining whether the ratio of the difference between the treatment current ($I_L$) subtracted by the reference curve ($I_{REF}$), divided by the reference current ($I_{REF}$), is less than a one percent change between the reference current ($I_{REF}$) and the present value for the treatment current ($I_L$). If there is greater than one percent change, the process proceeds to the step depicted in the block 166, of increasing the pulse duration ($t_p$) and decreasing the pulse period (T), and then the process proceeds back to the input of the block 158 and the voltage pulses ($V_L$) are applied to the formation. If in the block 168 it is determined that the change from the reference current is less than one percent, then the treatment current ($I_L$) is stored as the value for the current saturation treatment current ($I_{SAT}$) as depicted in a block 170. Then, in the step depicted in a block 172, the pulse duration ($t_p$) and the pulse period (T) are set such that the operating treatment current ($I_L$) is proportionate to the saturation current ($I_{SAT}$), wherein ($I_L$) is preferably set to be slightly less than the saturation current ($I_{SAT}$). In the preferred embodiment, ($I_L$) is selected to equal 0.95 time the saturation current ($I_{SAT}$). Then the process proceeds to the step depicted in a terminal 174, where the process of the present invention will return to the block 116, the step of applying pulsed voltage ($V_L$) to the earth formation as depicted in FIG. 5. Preferably, the pulse durations ($t_p$) of the treating currents are set to a value equal to 0.5 to 5.0 times a value of the pulse duration ($t_p$*) determined for which the value ($I_L$) is equal to 0.95 ($I_{SAT}$).

If the ratio of the period (T) to the pulse duration ($t_p$), also called a pulse on-off time ratio, is greater than 10, the electric treatment efficiency is drastically decreased, and the restructuring of voids in the medium is no longer self-supporting. For realization of a self-supporting processes, a pulsed current at the proper duration is required, which is continually corrected during the electrotreatment process. The resistivity of a saturated formation is dependent upon the duration of the pulsed current. If the duration ($t_p$) of the current pulses is decreased, the resistivity of saturated medium usually is increased and current in the medium is decreased, and the electrotreatment efficiency is drastically decreased. If the duration of the pulsed current is increased, the frequency of the pulsed current is decreased, which also decreases the efficiency of the treatment. Optimization of the duration of current pulses during the electrotreatment process is achieved by determining a value of the pulsed treatment current density (j) for each type of rock which is not less than a critical value (j*) of the pulsed current density. The critical value (j*) of the pulsed current density is the threshold value for current density (j) in the formation at which the character of change of rock permeability are irreversible. The critical value (j*) of the pulsed current density is preferably determined by taking into account the structure of voids in the formation and parameters of a saturating liquid, periodically measuring the critical value of pulse length tp*, setting tp=Btp*, where B=0.5–5.0, and selecting the period (T), which is the on-off time ratio of pulses, to a value which is a range of 5.0–10.0 times the treatment pulse duration ($t_p$).

Examples of the electric treatment of several hydrogeological wells are now given to illustrate the effectiveness of the electric treatment of wells to obtain irreversible change in permeability of earth formations. One well drilled into a limestone formation was electrically treated. The treated zone of the formation was not cased with a metal casing string, and electric treatment was effected with the a downhole electrode which was immersed into the well. A 75.0 amp pulsed current was passed through the limestone formation, and no changes were observed in the well production rate. Then, the current strength was increased to 300.0 amps, and the electric treatment was performed. The well then produced 2.88 times the pretreatment well production rate. The increased production rate remained stable for a number of years. Another well drilled into a clay formation was treated with a 75.0 amp pulsed electric current. The production rate of the well increased to several times that of production rates prior to treatment. The electric treatment of an oil well drilled in sandstone resulted in an increased oil production rate which was 4.66 times the production rate prior to treatment. During the electric treatment, the critical values of pulse duration ($t_p$*) at the beginning and the end of the process changed 3 times. Although the liquid yield after electrotreatment did not change, the percent of water in the produced liquids was decreased from a pretreatment water cut of 85% to water cut of 29.8% after treatment.

The results of the electric treatment of a well producing metal through underground leaching are given as an example of gas colmatation of the well. During electrotreatment with a 50.0 amp pulsed current, the production rate of the well increased by several dozen percent, which disappeared upon termination of electric treatment. Then, the well was treated with pulsed electric currents which exceeded the threshold value for irreversible permeability increases, which resulted in a production rate of 1.6 times the pretreatment production rate. Further electric treatment brought about a drastic decline in the well production rate which subsequently relaxed to its original value. Attempts to operate such wells using a unipolar current resulted in the electrodes being rapidly destroyed. When the polarity of the treating electric current was periodically reversed, the service life of the electrodes was drastically increased over that encountered using unipolar currents.

The present invention provides several advantages over prior art methods of electrically treating earth formations to changed the characteristics of fluid flow through the formations. Changes in the resistivity of the formation zone being treated are monitored, such that excessive current will not be applied to the formation. The duration of pulses of the electric current applied to the formation are changed according to the changes in the formation resistivity to optimize both the effectiveness and the efficiency of the electric treatment. This prevents excessive electric current from being applied to the formation while treating the formation with electric currents which are of a current density which is greater than that at which irreversible changes occur in the formation. Extended electric treatments may thus be applied to formations such that permeability of the formation is increased, resulting in improved production rates for wells treated according to the present invention.

Although the preferred embodiment has been described in detail, it should be understood that various changes, substitutions and alterations can be made therein without departing from the spirit and scope of the invention as defined by the appended claims.

What is claimed is:

1. A method of electrotreating an earth formation to affect changes in the permeability of the earth formation, comprising the steps of:

providing a pulsed voltage power supply having electrodes and an output for applying a substantially continuous sequence of voltage pulses of selectable pulse durations to the electrodes;

electrically connecting the electrodes to a zone of the earth formation;

selecting an amplitude for the voltage pulses applied to the electrodes to cause an electric treatment current to flow within the zone at a desired current density which will cause irreversible changes in the permeability of the formation;

selecting the pulse durations of the voltage pulses applied to the electrodes to correspond to maximum values for the conductivity of the formation;

applying to the earth formation substantially continuous sequences of the voltage pulses having respective ones of the pulse durations which correspond to various treatment time intervals; and wherein the pulse durations which correspond to the maximum values for the conductivity of the formation are determined for the various treatment time intervals during treatment of the formation zone.

2. The method of claim 1, wherein the pulse durations are selected to have values which are equal to the product of a constant times critical pulse durations at which formation conductivities are substantially equal to the maximum values for the conductivity of the formation, and the constant is selected from the range of 0.5 to 5.0.

3. The method of claim 1, wherein periods of the voltage pulses are substantially equal to five to ten times corresponding ones of the pulse durations.

4. The method of claim 1, wherein the pulse durations are substantially equal to critical pulse durations at which maximum values for the conductivity of the formation occur.

5. The method of claim 1, wherein electrotreatment is continued until a final saturation current is detected which is substantially equal to an initial saturation current.

6. The method of claim 1, wherein the treatment time intervals have a duration of no more than one hour.

7. The method of claim 1, wherein the polarities of the voltage pulses within the substantially continuous sequences of voltage pulses are varied according to a selected pattern.

8. A method of electrotreating an earth formation to affect changes in the permeability of the earth formation, comprising the steps of:

providing a pulsed voltage power supply having electrodes and an output for applying voltage pulses of selectable pulse durations to the electrodes;

electrically connecting the electrodes to a zone of the earth formation;

selecting an amplitude for the voltage pulses applied to the electrodes to cause an electric treatment current to flow within the zone at a desired current density which will cause irreversible changes in the permeability of the formation;

selecting the pulse durations of the voltage pulses applied to the electrodes to correspond to maximum values for the conductivity of the formation;

wherein the pulse durations which correspond to the maximum values for the conductivity of the formation are determined for various treatment time intervals during treatment of the formation zone;

wherein the step of selecting the pulse durations includes the steps of varying the pulse durations to determine a saturation current and a critical value of the pulse duration which corresponds to a treatment current which is proportionate to the saturation current, selecting a value of the pulse duration to be proportionate to the critical value of the pulse duration, and, after the treatment time intervals, repeating the steps of varying the pulse durations and selecting the value of the pulse duration until a final saturation current is detected.

9. The method of claim 8, wherein the pulse durations are incrementally increased until the saturation currents are detected.

10. The method of claim 8, wherein the final saturation current is selected to be substantially equal to an initial saturation current.

11. A method of electrotreating an earth formation to effect changes in the fluid flow characteristics of the formation, comprising the steps of:

providing a pulsed voltage power supply having electrodes and a selectable output for applying voltage pulses of selectable amplitudes, pulse durations and periods to the electrodes, and a current sensor for determining an amplitude value of current passing through one of the electrodes;

electrically connecting the electrodes to a zone of the earth formation;

determining a desired current flow within the zone according to selected characteristics of the earth formation;

selecting a value for the amplitude of the voltage pulses to apply the desired current flow within the zone;

initially applying an initial substantially continuous sequence of the voltage pulses to the zone, with an initial pulse duration and an initial period;

determining an amplitude value of the current passing through the one of the electrodes;

varying the pulse duration and the period of the voltage pulses until an initial saturation current is detected;

setting the pulse duration and the period to a first set point, such that the amplitude value of the current passing through the one of the electrodes is proportionate to the amplitude of the initial saturation current;

applying a first substantially continuous sequence of the voltage pulses to the formation at the first set point for the pulse duration and the period, for a selected time duration; and after the first selected time duration, repeating the steps of varying, setting and applying, to determine further saturation currents, to set the pulse duration and the period at further set points and then to applying further substantially continuous sequences of the voltage pulses at further set points for the pulse duration and the period for further time durations according to values detected for the saturation currents, until a final value for the saturation current is detected.

12. The method of claim 11, wherein the periods are selected to be proportionate to corresponding ones of the pulse durations, such that the periods have values which are within a range of five to ten times that of the corresponding ones of the pulse durations.

13. The method of claim 11, wherein the pulse durations are selected to correspond to a multiple of 0.5 to 5 times critical pulse durations, and the critical pulse durations are determined values at which the current flows are substantially equal to 0.95 times respective ones of the determined saturation currents.

14. The method of claim 11, wherein the final saturation current is substantially equal to the initial saturation current.

15. The method of claim 11, wherein the time durations define treatment time intervals which have durations of no more than one hour.

16. The method of claim 11, wherein the polarities of the voltage pulses are varied according to a selected pattern.

17. The method of claim 11, wherein:

the periods are selected to be proportionate to corresponding ones of the pulse durations, such that the periods have values which are within a range of five to ten times that of the corresponding ones of the pulse durations; and the pulse durations are selected to correspond to a multiple of 0.5 to 5 times critical pulse durations, and said critical pulse durations are determined values at which the current flows are substantially equal to 0.95 times respective ones of the determined saturation currents.

18. A method for changing the permeability of an earth formation by applying pulsed current to a zone of the formation, comprising the steps of:

determining a critical value (j*) of a pulsed current density which corresponds to a level of current density at which irreversible changes in the fluid flow characteristics of the formation zone occur, taking into account a particular type of rock which characterizes the formation, the structure of voids in the formation and parameters of a saturating liquid of within the formation;

selecting a preliminarily value of the pulsed current density (j) applied to the zone of the formation which is not substantially less than a critical value (j*) of the pulsed current density;

periodically determining critical values of pulse duration (tp*) which correspond to saturation points of the current flow within the formation zone during the treatment;

periodically selecting pulse durations (tp) which are proportionate to the periodically determined critical values of the pulse durations (tp*), according to the formula tp=Btp*, where B is selected within a range of 0.5 to 5; and wherein the periods (T) of pulses of the pulsed current applied to the formation are periodically set such that an on-off time ratio of the pulse periods (T) to corresponding ones of the pulse durations (tp) are not substantially greater than 10.

19. The method of claim 18, wherein the polarity of the pulsed current is periodically reversed.

20. The method of claim 18, wherein the critical value (j*) of the pulsed current density is determined by the equation:

$$j^* = k\sqrt{\frac{(E_a)(m)}{(\rho_e)(\tau)}},$$

where k is a coefficient characterizing the structure of a void in the medium, k=0.5–0.001;

$E_a$ is activation energy of process (j);

m is the porosity of the medium, (fractions of a unit);

$\rho_e$ is the specific resistance of the saturating liquid, (Ohm); and $\tau$ is the peculiar scale of time of energy dissipation (s).

21. The method of claim 20, wherein the activation energy Ea of process (j) is determined, in order to affect a change in the permeability of the formation, according to the equation:

$$E_a = \frac{\alpha\delta * C\rho}{\beta}$$

where $\delta$* is the minimum value of the tensile strength of a cementing agent for cycles influence (bar);

C is the heat capacity of a solution, (J/kg degree);

$\rho$ is the density of the medium, (kg/m);

$\beta$ is the coefficient of thermal expansion of the saturating liquid, (1/degree), $\alpha$ is the coefficient of volume expansion of the saturating liquid, (1/bar), $\alpha$ is possible to estimate, using the equation:

$$\tau = \frac{d^2}{a^2}$$

where d is the peculiar scale of nonuniformity, e.g., grain size, (m);

$a^2$ is the piezoconductivity coefficient, $a^2=\lambda/C\ \rho$ ($m^2/s$); and $\lambda$ is the heat conductivity coefficient, (J/m degree s).

22. The method of claim 20, wherein the value of the activation energy (Ea) is experimentally determined.

23. The method of claim 18, wherein the values of the critical pulse durations (tp*) are determined according to the condition that the critical pulse durations (tp*) correspond to current densities of 0.95 times the maximum current flows detected for the formation zone during treatment.

24. The method of claim 18, wherein the pulse durations (tp) are selected such that conductivities of the formation zone, in relation to the pulsed current, will be substantially equal to the maximum conductivity of the formation during treatment.

25. An apparatus for selectively operating to change the permeability of a zone of an earth formation, comprising:

means for applying pulsed electric currents to the formation zone, said means for applying having a power control unit for operatively controlling time parameters of said pulsed electric current;

means for setting said time parameters of said pulsed currents, said means for setting said time parameters being connected to said power control unit for controlling said time parameters, said time parameters including the durations of said pulses and the periods of said pulses;

a current sensor which detects said pulsed currents applied to the formation zone; and said means for setting said time parameters being connected to an output of said current sensor and being operated to periodically vary said time parameters to determine values of saturation currents applied to the formation zone, and to adjust said time parameters of said pulsed currents according to corresponding ones of said determined saturation currents.

26. The apparatus of claim 25, wherein said means for setting said time parameters sets said time parameters during various treatment time intervals such that said pulsed currents applied to the formation are substantially equal to respective ones of said determined saturation currents during said treatment time intervals.

27. An apparatus for electrotreating an earth formation to effect changes in the fluid flow characteristics of the formation, comprising:

a pulsed voltage power supply having a power control unit for selectively determining pulse durations and pulse periods of voltage pulses and electrodes for electrically connecting to the formation for applying said voltage pulses to the formation;

a current sensor for detecting values of electric currents passing through at least one of the electrodes;

a programmable controller connected to an output of said current sensor and said power control unit, such that said pulse durations and said pulse periods of said voltage pulses are selected according to detected values of said electric current passing through said one of the electrodes; and said programmable controller periodically varying said pulse durations and said pulse periods to determine saturation currents corresponding to critical values for said pulse durations during various treatment time intervals, and then selecting set points for said pulse durations and said pulse periods during said treatment time intervals which correspond to respective ones of said saturation currents.

28. The apparatus of claim 27, wherein said programmable controller selectively sets said pulse durations at values which correspond to maximum values for conductivity of the formation.

29. The apparatus of claim 27, wherein treatment currents induced to flow in the formation are substantially equal to said saturation currents.

* * * * *